US006005532A

United States Patent [19]

Ng

[11] Patent Number: 6,005,532

[45] Date of Patent: Dec. 21, 1999

[54] ORTHOGONAL ANTENNA ARRANGEMENT AND METHOD

[75] Inventor: Shiu S. Ng, Kirkland, Wash.

[73] Assignee: Digital Control Incorporated, Renton, Wash.

[21] Appl. No.: 08/968,636

[22] Filed: Nov. 12, 1997

Related U.S. Application Data

[63] Continuation-in-part of application No. 08/835,834, Apr. 16, 1997.

[51] Int. Cl.[6] ..... H01Q 9/28

[52] U.S. Cl. ..... 343/867; 343/797; 343/741

[58] Field of Search ..... 343/867, 741, 343/742, 770, 789, 896, 898, 795, 797, 732, 748

[56] References Cited

U.S. PATENT DOCUMENTS

| | | | |
|---|---|---|---|
| 4,001,834 | 1/1977 | Smith | 343/754 |
| 5,699,048 | 12/1997 | Galloway | 340/572 |

*Primary Examiner*—Don Wong
*Assistant Examiner*—James Clinger
*Attorney, Agent, or Firm*—Mike Pritzkau; Steve Shear

[57] ABSTRACT

An antenna member, associated orthogonal antenna arrangement and method are disclosed. The antenna member is configured such that an orthogonal antenna arrangement may utilize two or three identical ones of the disclosed antenna member. Accordingly, the antenna member includes a support member defining a through hole which includes a predetermined configuration. Furthermore, an arrangement of conductive members is supported by the support member and surrounds the through hole such that an antenna pattern is defined along an axis which extends through the through hole. The predetermined configuration of the through hole is such that a two orthogonal axis antenna subassembly may be formed by receiving a first one of the antenna members in the predetermined configuration of the through hole of a second one of the antenna members in a way which arranges the axes of the first and second antenna members orthogonally with respect to one another. A three axis orthogonal antenna assembly may be formed by receiving the two orthogonal axis antenna subassembly in the predetermined configuration of the through hole of a third one of the antenna members in a way which positions the axis of the antenna pattern defined by the third antenna member orthogonally with respect to the axes of the antenna patterns defined by the first and second antenna members.

33 Claims, 4 Drawing Sheets

ORTHOGONAL ANTENNA ARRANGEMENT AND METHOD

CROSS-REFERENCE TO RELATED APPLICATION

The present application is a continuation-in-part of U.S. patent application Ser. No. 08/835,834 (Attorney Docket No. DCI-P006), entitled "SYSTEMS, ARRANGEMENTS AND ASSOCIATED METHODS FOR TRACKING AND/OR GUIDING AN UNDERGROUND BORING TOOL", filed Apr. 16, 1997, which is incorporated herein by this reference.

BACKGROUND OF THE INVENTION

The present invention is related generally to multi-axis antenna arrangements and more particularly to an orthogonal multi-axis antenna arrangement in which the center of the overall antenna pattern is established with a relatively high degree of precision at a known point of intersection along two or three antenna axes. An associated method is disclosed.

Establishing the location of an electromagnetic signal source is important in a range of different applications including, but not limited to locating an underground boring tool using a locating signal which is transmitted from the boring tool. Generally, in such applications, antennas such as, for example, dipole antennas are used to measure the signal strength of the locating field along orthogonally opposed axes at one or more above ground locations. The measured signal strengths are then used to calculate the position of the boring tool. Unfortunately, however, locating applications which contemplate high levels of precision are typically limited by inaccurate signal strength measurements when prior art multi-axis antenna arrangements are used. The inaccuracy can be attributed to two significant sources: (1) it is inherently difficult to establish the origin/center of the antenna pattern of these prior art antenna arrangements in a very precise way and (2) particularly in the instance of a three axis orthogonal antenna arrangement, it is improbable that the three antenna axes actually intersect at one point such that electromagnetic field measurements taken by the arrangement actually represent, as nearly as possible, the electromagnetic field strength at a single point. In fact, when three dipole antennas are used, it is submitted that intersection of the three antenna axes at a single point which also comprises the center point of the antenna pattern of each of the dipoles is not possible.

The above incorporated U.S. application discloses a number of embodiments of a highly advantageous locating system for use in not only locating, but tracking an underground boring tool. In each of these embodiments, one or more above ground receivers include antenna clusters which are used to receive the dipole electromagnetic locating signal that is emanated from the underground location of the boring tool. In order to satisfy the need for an accurate orthogonal antenna, a highly advantageous cubic antenna arrangement is disclosed for use as the antenna cluster in the above ground receivers.

While the cubic antenna arrangement disclosed in the above incorporated application remains highly effective in solving the problems encountered in precision measurement of locating signal strength, the present invention discloses another highly advantageous and heretofore unseen antenna arrangement which also provides for precise measurement of a locating field at a single point and which further provides for remarkable ease of manufacture; high levels of manufacturing repeatability; highly stable, consistent performance; and reduced complexity in associated signal conditioning circuitry.

SUMMARY OF THE INVENTION

As will be described in more detail hereinafter, there is disclosed herein an antenna arrangement and associated method. The antenna arrangement comprises a first support member defining a first through hole having a first predetermined configuration. The first support member includes a first conductive pattern surrounding the first through hole and serving as a first antenna defining a first axis which which extends through the first through hole. A second support member includes a second conductive pattern serving as a second antenna defining a second axis. In accordance with the present invention, the second support member is positioned in the first through hole of the first support member in a way which arranges the first and second axes of the antenna patterns orthogonally with respect to one another.

In one aspect of the present invention, the antenna arrangement may include a third support member defining a second through hole having a second predetermined configuration. The third support member also includes a third conductive pattern surrounding the second through hole and serving as a third antenna defining a third axis which extends through the second through hole. In addition, the second predetermined configuration of the second through hole is such that the first and second support members are received in the second through hole of the third support member in a way which arranges the third axis of the third antenna orthogonal to the first and second axes of the first and second antennas.

In another aspect of the present invention, an antenna member is disclosed that is configured such that an orthogonal antenna arrangement may utilize two or three identical ones of the disclosed antenna member. Accordingly, the antenna member includes a support member defining a through hole which includes a predetermined configuration. Furthermore, an arrangement of conductive members is supported by the support member and surrounds the through hole such that an antenna pattern is defined along an axis which extends through the through hole. The predetermined configuration of the through hole is such that a two orthogonal axis antenna subassembly may be formed by receiving a first one of the antenna members in the predetermined configuration of the through hole of a second one of the antenna members in a way which arranges the axes of the first and second antenna members orthogonally with respect to one another. Thereafter, a three axis orthogonal antenna assembly may be formed by receiving the two orthogonal axis antenna subassembly in the predetermined configuration of the through hole of a third one of the antenna members in a way which positions the axis of the antenna pattern defined by the third antenna member orthogonally with respect to the axes of the antenna patterns defined by the first and second antenna members.

In still another aspect of the present invention, an antenna arrangement is made up of two or three antenna members. Each antenna member includes an arrangement of conductors defining an antenna pattern which includes a respective axis. The overall antenna arrangement is configured such that the respective axes of the antenna patterns intersect at a particular point.

BRIEF DESCRIPTION OF THE DRAWINGS

The present invention may be understood by reference to the following detailed description taken in conjunction with the drawings briefly described below.

DETAILED DESCRIPTION OF THE INVENTION

Figure 1:
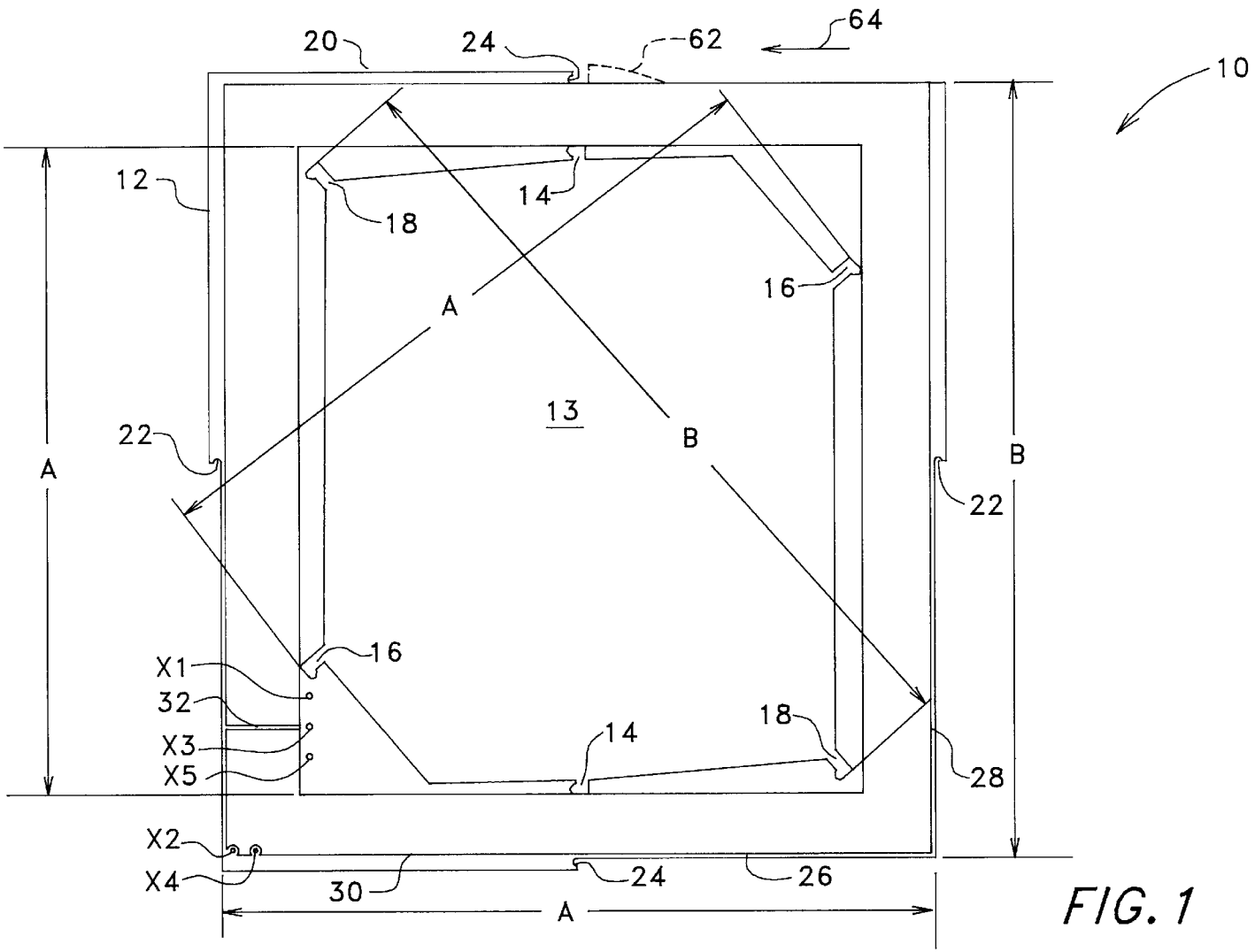
FIG. 1 is a diagrammatic elevational view of an antenna member of the present invention shown here to illustrate details of its construction.

Attention is immediately directed to FIG. 1 which illustrates an antenna member manufactured in accordance with the present invention and generally indicated by the reference numeral 10. Antenna member 10 includes a multi-layer printed circuit board 12 defining an opening 13 having a predetermined configuration which includes first, second and third pairs of opposing notches 14, 16 and 18, respectively. The notches are configured having a width (not indicated) which is equal to or slightly less than the thickness (not shown) of printed circuit board 12 such that an appropriate edge of a similar board is slidably receivable in the notches, as will be seen. Antenna member 10 further includes an outer peripheral edge 20 which defines first and second opposing pairs of stops 22 and 24, respectively. For purposes of clarity, the discussion relating to FIG. 1 describes antenna member 10 in the orientation of FIG. 1, however, it should be appreciated that this language is not intended to be limiting in any way.

Continuing with a description of antenna member 10, a lower edge 26 includes a width A which is substantially equal to the distance defined between first pair of opposing notches 14 and second pair of opposing notches 16, as indicated. Width A is maintained in the vertical direction along antenna member 10 up to the position of first pair of opposing stops 22. Thereafter, along the remaining height of the antenna member, its width is significantly greater than A. A side edge 28 of antenna member 10 includes a width B which is substantially equal to the distance defined between third pair of opposing notches 18, as indicated. Width B is maintained horizontally along antenna member 10 up to the position of second pair of opposing stops 24. Along the width of the antenna member to the left of stops 24 in the figure, its width is significantly greater than B. The purpose of the dimensional relationships just described will become apparent within the context of a subsequent discussion.

Having described the antenna member of the present invention with regard to specific attributes of its dimensions, a description of printed circuit board 12 will now be provided. As mentioned above, printed circuit board 12 comprises a multi-layer board. In the present example, a six layer board is used. In FIG. 1, layer 1 is disposed on the front (visible) side of printed circuit board 12, as indicated by the reference numeral 30, and is configured as a conductive plane. Layer 6 (not shown) is identical to layer 1 (when seen through the thickness of printed circuit board 12) and is disposed directly behind layer 1 on the back side of printed circuit board 12 such that layers 1 and 6 are in a confronting relationship with layers 2–5 positioned therebetween. Moreover, layers 1 and 6 each define a slot 32 which breaks the conductive planes such that a shorted loop or turn is not formed. In this manner, layers 1 and 6 serve as electrostatic shields which cooperate to protect the inner layers from any external electric fields while allowing the reception of magnetic fields.

Figure 2:
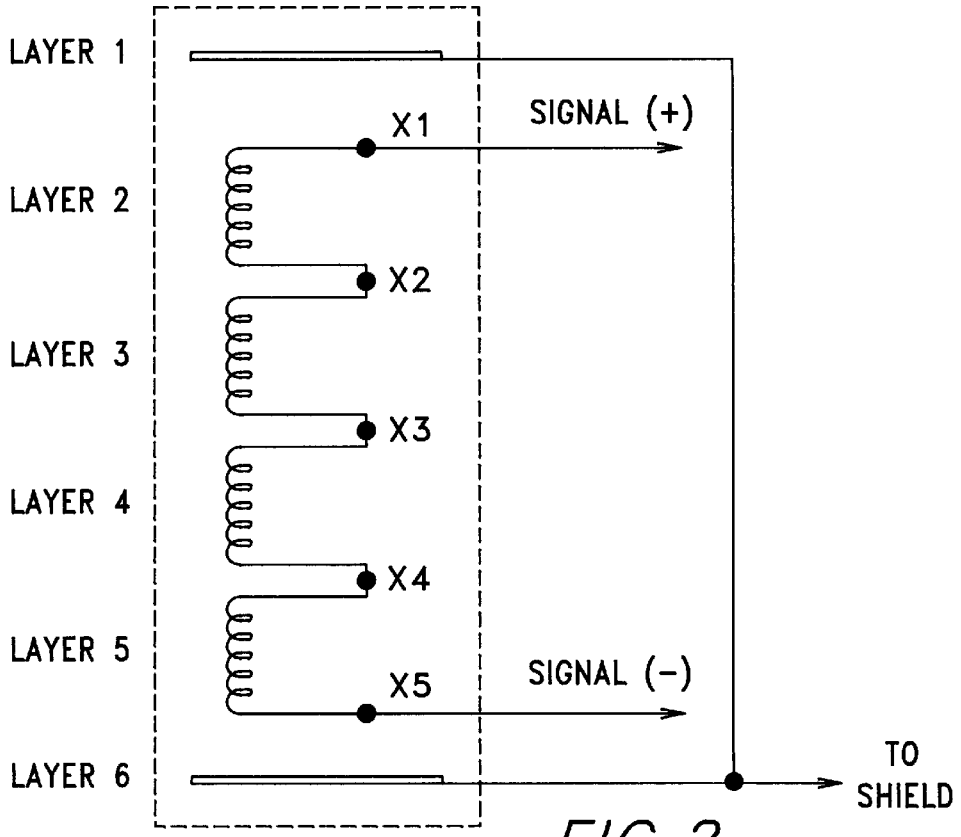
FIG. 2 is a schematic diagram illustrating the electrical configuration of the antenna member of FIG. 1.

Turning to FIG. 2 in conjunction with FIG. 1, the arrangement and electrical interconnection of layers 1–6 are illustrated. Normally, layers 1 and 6 are electrically connected with the grounded shield of a coaxial cable (not shown). Layers 2–5 comprise inductive patterns which are electrically interfaced using a series of vias X1–X5 in a manner which is known in the art. Specifically, vias X2–X4 are used to connect layers 2–5 in series while a signal input/output is provided between X1 and X5.

Figure 3:
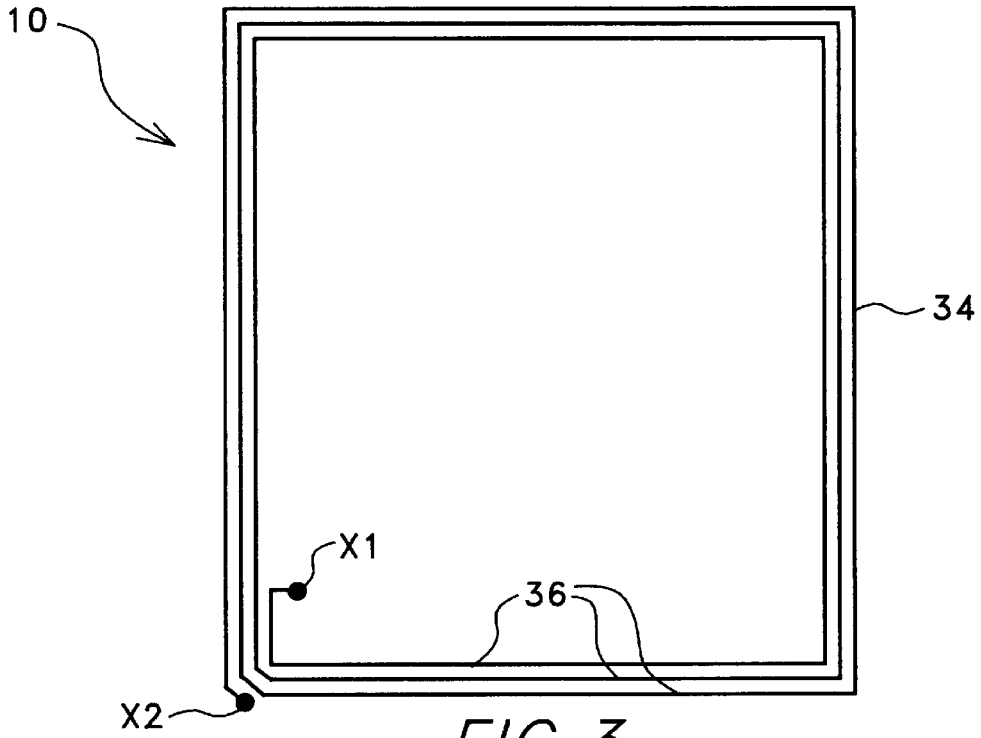
FIG. 3 is diagrammatic plan view illustrating the layout of a conductive pattern which comprises one layer of the antenna member of FIGS. 1 and 2.

Referring to FIGS. 3, layer 2 is diagrammatically illustrated as an orthorectangular conductive pattern 34 which defines three inductive loops 36. It should be appreciated that only three loops have been shown for illustrative purposes and that many more turns or loops may readily be provided. In an actual working embodiment, approximately 50 turns were used per layer with excellent results in the intended receiving application. Moreover, it should also be appreciated that any suitable number of layers may be used. As described above, pattern 34 of layer 2 is disposed directly between layer 1 and layer 6 whereby to take advantage of the electrostatic shielding provided by these outermost layers. Layers 3–5 (shown schematically in FIG. 2) comprise conductive patterns which are essentially identical in appearance with pattern 34 of layer 2 except, of course, for their individual interconnection with vias X1–X5. For this reason, these patterns are not shown individually and will not be described for purposes of brevity. However, it should be appreciated that the pattern of each layer is arranged such that induced current flows in the same direction with respect to the induced current flow in the other layers such that the layer currents are additive in conjunction with their electrical interconnection.

It should be appreciated that the present invention is not limited to the use of a printed circuit board configured in the form of an antenna, but contemplates the use of any suitable form of antenna in accordance with the teachings herein. However, the printed circuit board antenna implementation is particularly advantageous in view of the accuracy and consistency with which printed circuit boards are typically manufactured. These characteristics translate directly into consistent positional orientation and uniformity in the antenna pattern from one antenna member to the next. In applications such as, for example, underground locating where it is desirable to measure the strength of a locating signal at a single, known point along a number of orthogonal axes, the antenna member of the present invention is highly advantageous.

Figure 4:
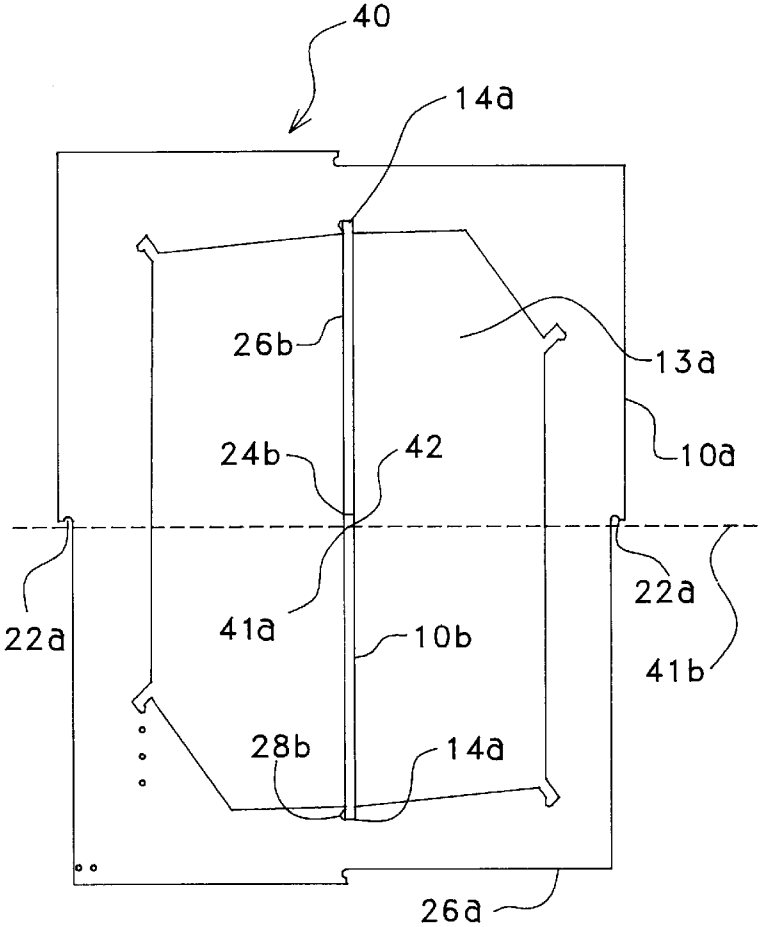
FIG. 4 is diagrammatic illustration showing an orthogonal antenna subassembly comprised of two of the antenna members of FIG. 1 such that a two axis orthogonal arrangement is formed.

Turning to FIG. 4 and having described antenna member 10 in sufficient detail, the formation of a multi-orthogonal axis antenna arrangement, generally indicated by the reference numeral 40, using three identical ones of antenna members 10 will be described. To that end, first and second antenna members are designated by the reference numerals 10*a* and 10*b*, respectively. For purposes of simplicity, the various features of antenna members 10*a* and 10*b* (and any subsequently recited antenna members) are referred to by appending an appropriate letter to the reference numbers originally applied in FIG. 1. For example, the opening in antenna member 10*a* is referred to as opening 13*a*.

Still referring to FIG. 4, lower edge 26*b* of antenna member 10*b* is slidably received in opposing slots 14 of antenna member 10*a* such that stops 22*b* (not visible) are engaged against the back side of antenna member 10*a*. In other words, edge 26*b* of antenna member 10*b* is first engaged with slots 14*a* from behind antenna member 10*a* and, thereafter, inserted through opening 13*a* in a direction toward the viewer until stops 22*b* engage the back surface of antenna member 10*a*. In addition, edge 28*b* of antenna member 10*b* is facing downward in the orientation of FIG. 4 such that stops 24*b* (only one of which is visible) are facing downward. Thus, antenna members 10*a* and 10*b* are arranged such that a central axis 41*a* (seen as a point in the representation of FIG. 4) of the antenna pattern of antenna member 41*a* is orthogonal to and intersects a central axis 41*b* of the antenna pattern of antenna member 10*b* at a point 42. It should be mentioned that the subassembly of antenna members 10*a* and 10*b* may be used as a dual orthogonal axis antenna arrangement with the provision of appropriate electrical connections.

Figure 5:
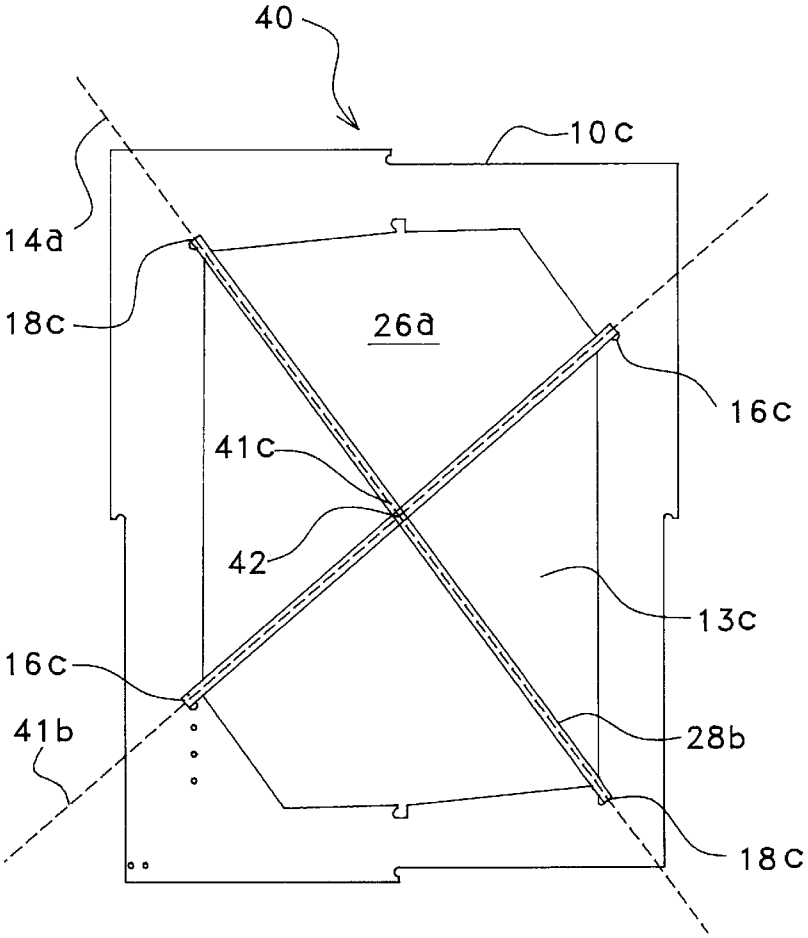
FIG. 5 is diagrammatic illustration showing the orthogonal antenna subassembly comprised of the two antenna members of FIG. 4 in conjunction with an additional antenna member such that a three-axis orthogonal arrangement is formed.

Referring to FIG. 5 in conjunction with FIG. 4, antenna members 10*a* and 10*b* are assembled, as described (viewed from below in the orientation of FIG. 4) having edges 26*a* and 28*b*, respectively, facing the viewer. Further, an antenna member 10*c* is arranged such that assembled antenna members 10*a* and 10*b* are inserted in opening 13*c* of antenna member 10*c* by first engaging edge 26*a* of antenna member 10*a* with notches 16*c* of antenna member 10*c* while simultaneously engaging edge 28*b* of antenna member 10*b* with notches 18*c* of antenna member 10*c*. Thereafter, the subassembly of antenna members 10*a* and 10*b* is slidably urged in the direction of the viewer such that stops 22*a* of antenna member 10*a* and stops 24*b* of antenna member 10*b* engage the back surface of antenna member 10*c*. In this manner and due to the predetermined positions of stops 22*a* and 24*b*, an axis 41*c* (visible as a point in the present figure) of antenna member 10*c* is arranged in an orthogonal orientation with respect to axes 41*a* and 41*b* such that axis 41*c* also passes through point 42. The antenna members may be secured with respect to one another in any suitable manner. For example, epoxy may be applied where the stops of one antenna member abut against another antenna member or, as another example, the edges of the antenna members may be configured to include a catch arrangement 62 (see FIG. 1) indicated as a dashed line which allows an edge (not shown) of another antenna member to initially slide only in the direction indicated by an arrow 64, thereby providing a one-way locking feature. After the three antenna members are co-arranged, electrical connections may be made in any suitable manner with a receiver and/or transmitter package (not shown).

Thus, a highly advantageous three axis orthogonal antenna arrangement has been provided which features (1) consistency of the antenna pattern along each axis, (2) precise location of the center of the antenna pattern along each axis at a single, common point and (3) an inexpensive and well known manufacturing format.

Figure 6:
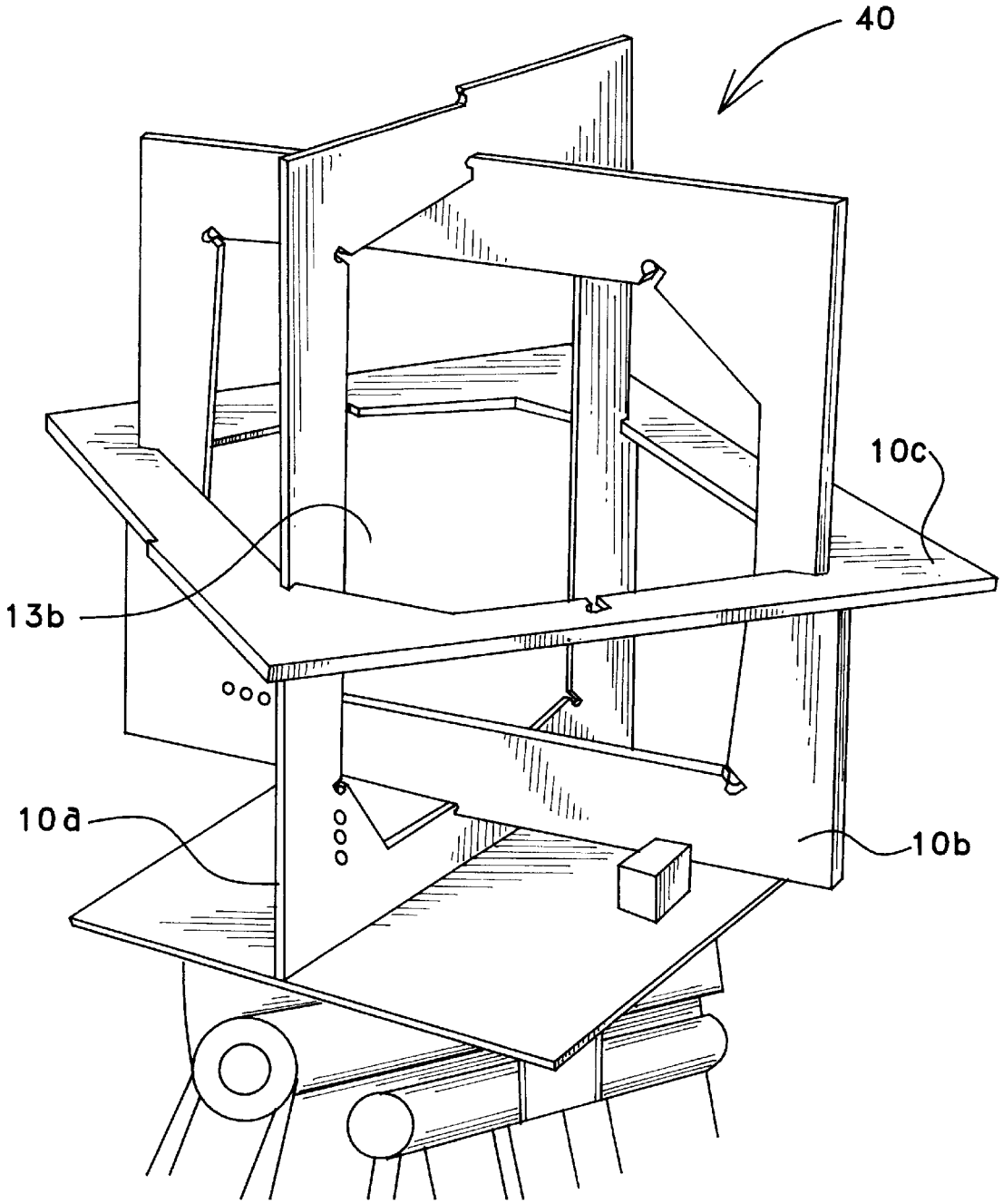
FIG. 6 is diagrammatic perspective view showing the orthogonal antenna arrangement of FIG. 5.

Turning to FIG. 6, completed antenna arrangement 40 using antenna members 10*a–c* is illustrated in a perspective view. It is mentioned once again that the present invention utilizes three identical antenna members in arrangement 40 which are configured in a highly advantageous way. However, it is to be understood that these three members are not required to be identical in accordance with the teachings herein. Moreover, it is noted that opening 13*b* in antenna member 10*b* is not needed. Therefore, opening 13*b* may be eliminated with no discernable influence on the characteristics of the overall arrangement provided that any conductive material (i.e., copper cladding) is removed from layers 1–6 in the area in which the opening would have been formed.

With regard to the use of the antenna arrangement of the present invention in locating applications such as, for example, underground location of a boring tool, the antenna arrangement is well suited for use in "walk-over" detectors similar to that described in U.S. Pat. No. 5,337,002 which is incorporated herein by reference. In addition, the antenna arrangement of the present invention is equally well suited for use in stationary receiver applications such as described in above incorporated U.S. patent application Ser. No. 08/835,834 (Attorney Docket No. DCI-P006).

It should be appreciated that the antenna arrangement of the present invention may be used as an orthogonal axis transmitting antenna. In this regard, in one application where the transmission of a rotating magnetic field is required, the antenna members can be driven in sequence to generate a three dimensional field as described in copending U.S. patent application Ser. No. 08/643,209 (attorney docket no. DCI 1P008) entitled METHOD AND ARRANGEMENT FOR DETECTING A BURIED CABLE BY AN INGROUND BORING DEVICE, which is incorporated herein by reference. In another application, each orthogonal antenna member of a first antenna arrangement may transmit at a different frequency to a second, receiving orthogonal antenna arrangement so as to determine the position or orientation of either antenna arrangement. (See U.S. Pat. No. 4,054,881 as one instance of an application which benefits from the present disclosure.)

One other advantage of the present invention mentioned only briefly above resides in reducing the need for conditioning circuitry which drives the antenna arrangement. This advantage results, at least in part, due to a high degree of repeatability in manufacturing.

Because the orthogonal antenna arrangement and antenna member disclosed herein may be provided in a variety of different configurations and modified in an unlimited number of different ways, it should be understood that the present invention may be embodied in many other specific forms without departing from the spirit of scope of the invention. For example, in certain applications, a locating signal may be received along two orthogonal axes rather than three. In this instance, two antenna members may be appropriately used without the need for a third antenna member. As another example, the antenna arrangement may be designed such the antenna pattern axes of the various antennas do not intersect. Therefore, the present examples and methods are to be considered as illustrative and not restrictive, and the invention is not to be limited to the details given herein, but may be modified within the scope of the appended claims.

What is claimed is:

1. An antenna arrangement comprising:

a) a first planar support member defining a first through hole having a first predetermined configuration, said first planar support member including a first conductive pattern surrounding said first through hole and serving as a first antenna defining a first axis which extends through said first through hole; and b) a second planar support member including a second conductive pattern serving as a second antenna defining a second axis, said second planar support member being positioned in the first through hole of said first planar support member in a way which arranges the first and second axes orthogonally with respect to one another.

2. The arrangement of claim 1 wherein said first and second support members are substantially planer.

3. The antenna arrangement of claim 1 wherein the first and second axes intersect at a particular point.

4. The antenna assembly of claim 1 wherein said first support member defines a first set of opposing notches as part of the first predetermined configuration and wherein said second support member is configured for slidably engaging said first set of opposing notches.

5. The antenna assembly of claim 4 wherein said second support member includes an opposing pair of outer edges which are configured for slidably engaging said first set of notches.

6. The antenna assembly of claim 5 wherein each one of said opposing pair of outer edges includes means for limiting the slidable engagement of the opposing outer edges with the first set of notches such that said first and second axes of the antennas intersect at a particular point.

7. The antenna assembly of claim 6 wherein said limiting means includes a stop integrally formed as part of each opposing outer edge.

8. The antenna assembly of claim 1 wherein said first and second support members comprise first and second printed circuit boards and wherein said first and second conductive patterns are respectively formed as conductive traces on said first and second printed circuit boards.

9. The antenna member of claim 8 wherein said first and second printed circuit boards each comprise a multi-layered board such that each one of a plurality of layers includes a sub-pattern of said conductive pattern such that each sub-pattern surrounds said through hole and means for electrically interconnecting the sub-patterns of each printed circuit board such that electrical currents induced in the respective sub-patterns by an electromagnetic field are additive.

10. The arrangement of claim 1 further comprising:

c) a third support member defining a second through hole having a second predetermined configuration, said third support member including a third conductive pattern surrounding said second through hole and serving as a third antenna defining a third axis which extends through said second through hole, said first and second support members being positioned in the second through hole of the third support member in a way which arranges said third axis of said third antenna orthogonal to the first and second axes of the first and second antennas.

11. The arrangement of claim 10 wherein said third support member is substantially planer.

12. The antenna arrangement of claim 10 wherein said first, second and third axes intersect at a particular point.

13. The antenna assembly of claim 10 wherein said first, second and third support members are substantially identical.

14. The antenna assembly of claim 10 wherein said third support member defines a first and a second set of opposing notches as part of said second predetermined configuration and wherein said first support member is configured for slidably engaging said first set of opposing notches and said second support member is configured for simultaneously slidably engaging said second set of notches such that the first, second and third support members are positioned in a way which causes the first, second and third axes of the antennas to be orthogonal with respect to one another.

15. The antenna assembly of claim 14 wherein said first, second and third axes of the antennas intersect at a particular point.

16. The antenna assembly of claim 14 wherein said first and second members include first and second outer edge pairs which engage said first and second sets of notches, respectively, and wherein each outer edge pair includes means for limiting the slidable engagement of the first and second antenna members with the third antenna member.

17. The antenna assembly of claim 16 wherein said limiting means includes a stop integrally formed as part of each outer edge pair.

18. The antenna assembly of claim 16 wherein said limiting means is configured such that said first, second and third axes intersect at a particular point.

19. The antenna assembly of claim 10 wherein said first, second and third support members comprise first and second printed circuit boards and wherein said first, second and third conductive patterns are formed as conductive traces on said first, second and third printed circuit boards.

20. The antenna member of claim 19 wherein said first, second and third printed circuit boards each comprise a multi-layered board such that each one of a plurality of layers includes a sub-pattern of said conductive pattern such that each sub-pattern surrounds said through hole and means for electrically interconnecting the sub-patterns of each printed circuit board such that electrical currents induced in the respective sub-patterns by an electromagnetic field are additive.

21. A first antenna member especially suitable for use in an antenna assembly which also includes a second antenna member having a second antenna defining a second axis, said first antenna member comprising:

a) a planar support member defining a specifically configured through hole; and b) an arrangement of conductive members supported by said planar support member and surrounding said through hole so as to serve as a first antenna defining a first axis which extends through the through hole, the specific configuration of said through hole being such that said second antenna member is able to be received within said through hole in a way which positions the first axis of the antenna defined by the first antenna member orthogonally with respect to the second axis of the second antenna member.

22. The antenna member of claim 21 wherein the first axis of the first antenna of the first antenna member intersects the second axis of the second antenna of the second antenna member at a particular point.

23. The antenna member of claim 21 wherein said support member is substantially planer.

24. The antenna member of claim 23 wherein said support member comprises a printed circuit board and wherein said conductive pattern is formed as conductive traces on said printed circuit board.

25. The antenna member of claim 24 wherein said printed circuit board comprises a multi-layered board including a plurality of layers each of which defines a sub-pattern of said conductive pattern such that each sub-pattern surrounds said through hole and means for electrically interconnecting the sub-patterns such that electrical currents induced in the respective sub-patterns by an electromagnetic field are additive.

26. The antenna member of claim 21 wherein said second antenna member includes a substantially identical support member and wherein each support member defines a first set of opposing notches as part of said predetermined configuration and each support member includes a first pair of outer edges which are configured such that the outer edges of the support member of the second antenna member slidably engage said first set of opposing notches of the support member of the first antenna member.

27. The antenna member of claim 26 wherein each one of said outer edges includes means for limiting the slidable engagement of the edges with the first set of notches such that the first axis of the first antenna member and the second axis of the second antenna member intersect at a particular point.

28. The antenna member of claim 27 wherein said limiting means includes a stop integrally formed as part of each outer edge.

29. A first antenna member especially suitable for use in an antenna assembly which also includes a second antenna member and a third antenna member, said second and third antenna members each including second and third antennas, respectively, defining a second and third axis, said first antenna member comprising:

a) a planar support member defining a specifically configured through hole; and b) an arrangement of conductive members supported by said planar support member and surrounding said through hole so as to serve as a first antenna defining a first axis which extends through the through hole, the specific configuration of said through hole being such that said second antenna member and said third antenna member are able to be received within said through hole in a way which positions the first axis of the antenna defined by the first antenna member orthogonally with respect to the second axis defined by the second antenna member and the third axis defined by the third antenna member.

30. A method of assembling an antenna assembly comprising the steps of:

a) providing a first antenna including a first planar support member defining a first through hole having a first predetermined configuration, said first planar support member including a first conductive pattern surrounding said first through hole and serving as a first antenna defining a first axis which extends through said first through hole;

b) providing a second antenna member including a second planar support member having a second conductive pattern serving as a second antenna defining a second axis; and c) positioning said second planar support member in the first through hole of said first planar support member in a way which arranges the first and second axes orthogonally with respect to one another.

31. The method of claim 30 wherein said positioning step arranges said first and second axes to intersect at a particular point.

32. The method of claim 30 further comprising the steps of:

d) providing a third antenna member including a third support member defining a second through hole having a second predetermined configuration, said third support member including a third conductive pattern surrounding said second through hole and serving as a third antenna defining a third axis which extends through said second through hole; and e) after having positioned the second support member in the through hole of the first support member, arranging said first and second support members in the second through hole of the third support member in a way which causes said third axis of said third antenna to be orthogonal to the first and second axes of the first and second antennas.

33. The method of claim 32 wherein said first, second and third axes intersect at a particular point.

* * * * *

UNITED STATES PATENT AND TRADEMARK OFFICE

CERTIFICATE OF CORRECTION

PATENT NO. : 6,005,532
DATED : December 21, 1999
INVENTOR(S) : Shiu S. Ng

It is certified that error appears in the above-identified patent and that said Letters Patent is hereby corrected as shown below:

Column 2,
Line 12, change "first axis which which extends" to -- first axis which extends --

Column 4,
Line 20, change "FIGS.3" to -- FIG.3 --

Column 6,
Lines 24, 25 and 26, change "METHOD AND ARRANGEMENT FOR DETECTING A BURIED CABLE BY AN INGROUND BORING DEVICE" to -- SYSTEM INCLUDING AN ARRANGEMENT FOR TRACKING THE POSITIONAL RELATIONSHIP BETWEEN A BORING TOOL AND ONE OR MORE BURIED LINES AND METHOD --

Column 7,
Line 5, Claim 2 should be cancelled per Amendment 10/27/99
Line 52, change "planer" to -- planar --

Column 8,
Line 50, Claim 23 should be cancelled per Amendment 10/27/99

Signed and Sealed this

Eleventh Day of June, 2002

*Attest:*

*Attesting Officer*

JAMES E. ROGAN
*Director of the United States Patent and Trademark Office*